United States Patent [19]

Farris

[11] Patent Number: 4,805,947

[45] Date of Patent: Feb. 21, 1989

[54] DOOR HANDLE ASSEMBLY

[75] Inventor: Timothy M. Farris, Sterling Heights, Mich.

[73] Assignee: General Motors Corporation, Detroit, Mich.

[21] Appl. No.: 72,419

[22] Filed: Jul. 13, 1987

[51] Int. Cl.[4] ..... E05B 7/00

[52] U.S. Cl. ..... 292/336.3; 292/DIG. 23; 292/DIG. 38

[58] Field of Search ..... 292/336.3, 336.5, DIG. 38, 292/DIG. 23, 347

[56] References Cited

U.S. PATENT DOCUMENTS

| | | | |
|---|---|---|---|
| 1,668,553 | 5/1928 | Douglas | 292/DIG. 23 |
| 1,910,125 | 5/1933 | Root | 292/347 |
| 1,918,411 | 7/1933 | Lowe . | |
| 1,935,880 | 11/1933 | Koenig . | |
| 2,136,854 | 11/1938 | Knott . | |
| 2,186,666 | 1/1940 | Cereda . | |
| 2,668,076 | 2/1954 | Troche et al. . | |
| 2,680,640 | 6/1954 | Carry | 292/DIG. 23 |
| 3,069,889 | 12/1962 | Johnstone et al. | 292/336.3 |
| 3,081,617 | 3/1963 | McKay | 292/336.3 |
| 3,111,338 | 11/1963 | Kimble | 292/336.3 |
| 3,153,583 | 10/1964 | Sandor | 292/336.3 |
| 4,038,718 | 8/1977 | Reilhac et al. | 292/336.3 |
| 4,580,822 | 4/1986 | Fukumoto | 292/336.3 |

FOREIGN PATENT DOCUMENTS

| | | | |
|---|---|---|---|
| 97804 | 1/1964 | Denmark | 292/336.3 |
| 1186361 | 1/1965 | Fed. Rep. of Germany | 292/336.3 |
| 3024990 | 6/1982 | Fed. Rep. of Germany | 292/DIG. 23 |
| 1237504 | 6/1960 | France | 292/336.3 |
| 2359457 | 3/1978 | France | 292/336.3 |
| 895481 | 5/1962 | United Kingdom | 292/336.3 |

*Primary Examiner*—Gary L. Smith
*Assistant Examiner*—Eric K. Nicholson
*Attorney, Agent, or Firm*—Charles E. Leahy

[57] ABSTRACT

According to the invention a door latch includes a cylindrical plastic housing member adapted for mounting within an aperture of a vehicle door and having an integrally molded escutcheon which overlies the walls of the door panel defining the door aperture. A molded plastic cylindrical handle member is rotatably journaled within the housing for rotary movement. A plastic cylindrical actuator member rotatably journaled within the handle member is connected with the door latch to unlatch the door latch upon axial movement of the actuator member. A cam means acts between the handle member and the actuator to effect axial movement of the actuator member in response to rotary movement of the handle member. The housing member preferably has upper and lower walls having coaxially lined apertures, while the handle member and a guide member slidably carried by the handle member each have integral bosses adapted to slip fit within the apertures of the walls of the housing member. A spring acts between the housing member and the guide member urging axially apart movement so that the bosses are retained in engagement of the coaxially aligned apertures to journal the handle member on the housing for rotary movement.

7 Claims, 1 Drawing Sheet

DOOR HANDLE ASSEMBLY

The invention relates to a door handle assembly and more particularly to an automobile door handle comprised of coaxially arranged molded plastic cylindrical members.

BACKGROUND OF THE INVENTION

It is well known in motor vehicles to provide an outside door handle for unlatching a door latch. The handle is conventionally mounted on the surface of the door or within a recess of the door, and is operably connected with the door latch by a lever or a rod. In such door handles, the handle may be pivotally mounted so that lifting or rotating the handle operates the lever or rod to unlatch the door latch.

The present invention provides a new and improved door handle assembly comprised of molded plastic coaxially arranged tubular members having integral cam means therein adapted to effect unlatching of the door upon rotary movement of a handle.

SUMMARY OF THE INVENTION

According to the invention a door handle includes a cylindrical plastic housing member adapted for mounting within an aperture of a vehicle door and having an integrally molded escutcheon which overlies the walls of the door panel defining the aperture. A cylindrical handle member is rotatably journaled within the housing for rotary movement and has a handle grip extending through an opening in the housing and reaching outward through the aperture of the door for access by the vehicle user. A cylindrical actuator member, also of molded plastic, is rotatably journaled within the handle member and has associated means connected with the door latch to unlatch the door latch upon axial movement of the actuator member. A cam means acts between the handle member and the actuator to effect axial movement of the actuator member in response to rotary movement of the handle member. The housing member preferably has upper and lower walls having coaxially lined apertures, while the handle member and a guide member carried by the handle member and axially movable relative thereto each have integral bosses adapted to slip fit within the apertures of the walls of the housing member. A spring acts between the housing member and the guide member to urge axially apart movement so that the bosses are retained in engagement of the coaxially aligned apertures to thereby journal the handle member on the housing for rotary movement. The handle member, the actuator member, and the guide member are each circular cylindrical members which concentrically fit within one another to effectively journal one another for relative to axial and rotary movement.

BRIEF DESCRIPTION OF THE DRAWINGS

These and others objects, features and advantages of the invention will become apparent upon consideration of the following description of the preferred embodiment the appended drawings in which.

DESCRIPTION OF THE PREFERRED EMBODIMENT

Figure 1:
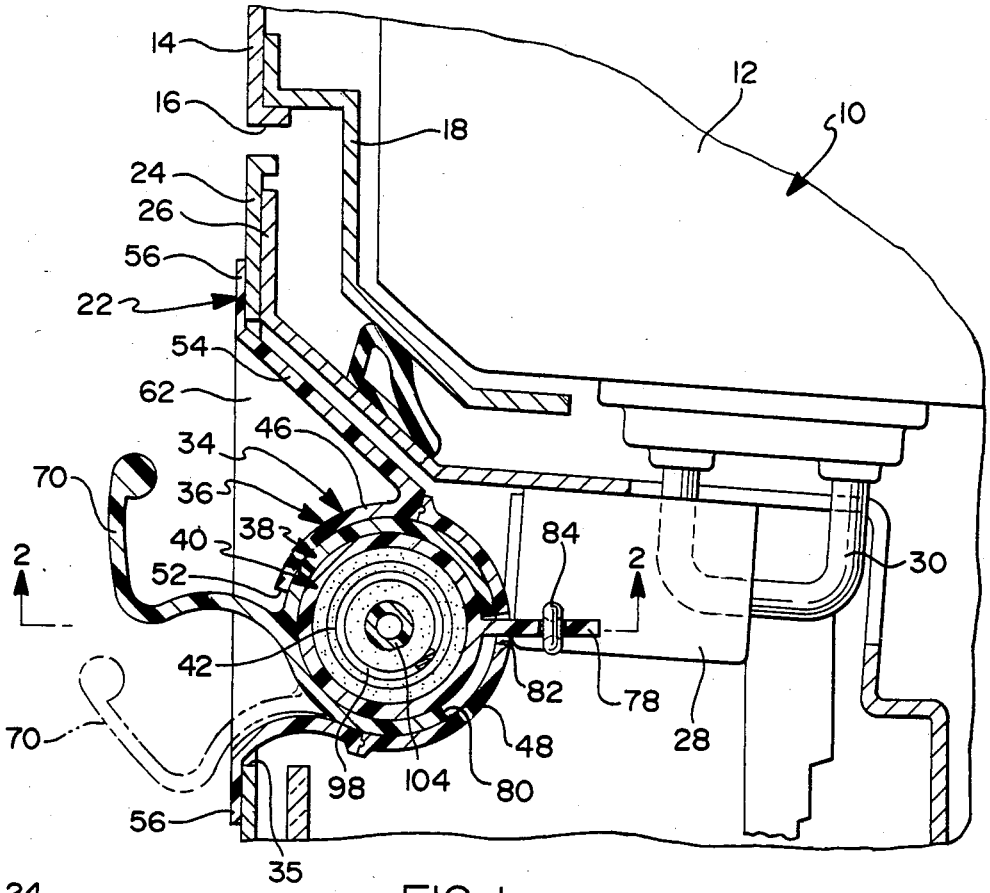
FIG. 1 is a fragmentary plan view of a vehicle door arrangement having parts broken away in section to show the door handle arrangement of this invention.

Referring to FIG. 1, it will be seen that vehicle body 10 includes a pillar 12 which supports the outer sheet metal panel 14 of the vehicle body. A door opening 16 is defined by a panel 18.

A door, generally indicated at 22, includes a sheet metal outer panel 24 and a door inner panel 26. The door is suitably mounted on the vehicle body by a pair of hinges, not shown. The door is latched in the closed position of FIG. 1 by a door latch assembly 28 which has a latch bolt, not shown, for engaging with a striker 30 suitably mounted on the vehicle body pillar 12.

A door handle assembly generally indicated at 34 is situated within an aperture 35 of door panel 24 and is comprised of molded plastic concentrically arranged cylindrical members including a housing member 36, a handle member 38 and actuator member 40 and a guide member 42.

Figure 2:
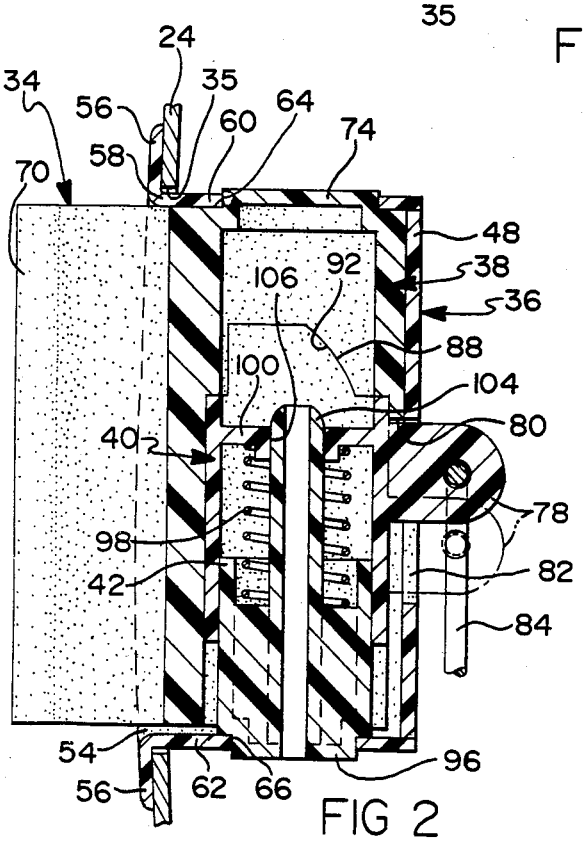
FIG. 2 is a sectional view of the door handle assembly the direction of arrows 2—2 of FIG. 1.

The housing member 36 includes an outer half 46 and an inner half 48 which are semi-circular in cross-sectional shape as seen in FIG. 1 and are glued or heated and fused together to define a circular cylindrical shape having a vertically extending opening 52 facing outwardly of the vehicle. The outer half 46 has an integral escutcheon 54 molded thereon which has a continuous outer flange 56 which overlies the door outer panel 24 around the edge of the door handle aperture 35. As best seen in FIG. 2, the housing member 36 includes an upper wall 60 and a lower wall 62 having respective circular apertures 64 and 66 which are coaxially aligned with one another. The housing member 36 is suitably mounted on the door by fasteners, not shown. For example, integral plastic snap fasteners can be formed on the housing member, or screws may be employed.

The handle member 38 has a circular cylindrical shape and is slidably and rotatably captured inside the housing member 36. A handle grip 70 is molded integrally with the handle member 38 and extends outwardly through the opening 52 in the housing member 36 for access by the vehicle user. As best seen in FIG. 2, the handle member 38 has an integral circular boss 74 at its upper end which rotatably seats within the circular aperture 64 of the upper wall 60 of housing member 36.

Figure 3:
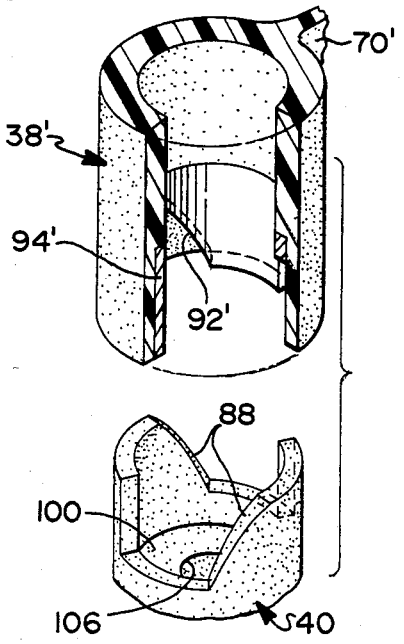
FIG. 3 is an exploded view showing the cam means acting between the door handle member and the latch actuator member.

The actuator member 40, also of molded plastic and having a circular cylindrical shape, is slidably mounted inside the handle member 38 in slip fit relationship therewith. The actuator member 40 has an integrally molded actuating arm 78 which reaches outwardly through an opening 80 in the handle member 38 and an aligned opening 82 in the housing member 36 so that the actuator member 78 can slide axially up and down but cannot rotate. The actuator member 78 is connected to a rod 84 which extends downwardly from the actuating member 78 and connects with the door latch assembly 28 in a manner to unlatch the door latch assembly 28 upon downward movement of the actuating arm 78 from its FIG. 2 solid line position to the FIG. 2 phantom line indicated position. The actuator member 40 has a pair of spiraling cam faces 88 at its upper end which mate with downward facing cam faces 92 provided inside the handle member 38. The cam faces may be integral with the member, like the cam faces 92 of handle member 38 as shown in FIG. 2, or, alternatively, the cam faces may be formed on a metal ring pressed into the handle member, like the cam ring 94' of the handle member 38' as shown in FIG. 3.

The guide member 42, also of molded plastic and having a circular cylindrical shape is mounted inside the actuator member 40 and has an integral circular cylindrical boss 96 at the lower end thereof which rotatably fits within the circular aperture 66 of the housing bottom wall 62. As best seen in FIG. 2 a coil compression spring 98 has one end seated on the guide member 42 and an upper end seated upon a wall 100 of the actuator member 40. The guide member 42 includes a central tube 104 which extends upwardly through a central aperture 106 of the actuator member wall 100 to further contribute to the concentric coaxial mounting of the guide member 42 inside the actuator member 40, as well as support the spring 98. Accordingly, the spring 98 acts to push the actuator member 40 upwardly so that the cam surfaces 88 of the actuator member 40 are held in mating contact with the downward facing surfaces 92 of the handle member 38. In addition, the effort of the spring works to push the handle member 38 upwardly so that its boss 74 is retained in the circular aperture 64 while the guide member 42 is pushed downwardly so that its boss 96 is seated in the aperture 66 of the lower housing wall 62. Accordingly, the spring maintains the handle member 38 inside the housing and effectively mounts the handle member 38 for rotary movement.

In operation, it will be understood that the vehicle user grips the handle grip 70 and rotates the handle member 38 from its solid line indicated position of FIG. 1 to the phantom line indicated position. This rotary movement of the handle member 38 carries the cam surfaces 92 of the handle member in the counterclockwise direction. The actuator member 40 cannot rotate with the handle member 38 because the actuator arm 78 is prevented from rotating by engagement with the walls of the slot 82 in housing member 36. Accordingly the rotary movement of the handle member 38 will cause the mating cam surfaces 92 and 88 to push the actuator member 40 axially downwardly as permitted by yielding of the spring 98 so that the actuating arm 70 pushes the actuator rod 84 down to unlatch the door.

When the operator releases the handle 70, the spring 98 urges the actuator member 40 upwardly and the cam surfaces 88 and 92 rotate the handle 38 back to the solid line indicated position of FIG. 1.

Thus it is seen that the invention provides a new and improved door handle assembly comprised entirely of molded plastic circular cylindrical members. In addition, the pivotal attachment of the handle to the housing is effected by integral bosses fitting within apertures and maintained in engagement therewith by a coil compression spring acting between the handle member and the guide member. Furthermore, it is appreciated that the tubular circular cylindrical shape of the molded plastic members enable the members to telescope together in slip fitting coaxial relationship which enables both axial and rotary movement therebetween. Furthermore, the integral molding of the escutcheon with the housing member results in a additional savings of parts and assembly labor. In addition, the molded plastic and door handle assembly may be mounted in a vertical orientation on the vehicle body. As an alternative to plastic molding, some or all of the parts of the door handle assembly may be die cast metal.

The embodiments of the invention in which an exclusive property or privilege is claimed are defined as follows:

1. A vehicle door, handle for mounting within an aperture of a vehicle door and actuating a door latch comprising:

a cylindrical housing member adapted for mounting within the aperture of the vehicle door;

a cylindrical handle member rotatably journaled within the housing for rotary movement about a vertical axis and having a handle grip extending outward through the aperture of the door;

a cylindrical actuator member journaled within the cylindrical handle member for vertical movement relative to the handle member movement and having associated means connecting with the door latch to unlatch the door latch upon vertical movement of the actuator member;

cam means acting between the handle member and the actuator member;

and means acting between the actuator member and the housing member and adapted to prevent the actuator member from rotating whereby rotary movement of the handle member effects vertical movement of the actuator member to effect unlatching of the door latch.

2. A vehicle door handle for mounting in an aperture of a vehicle door and actuating a door latch comprising:

a housing member adapted for recessed mounting within an aperture of the vehicle door and having upper and lower walls having coaxially aligned apertures;

a handle member having a handle grip extending outward through the aperture of the door and an integral boss adapted to slip fit into the aperture of one of the upper and lower walls of the housing member;

a guide member carried by the handle member and rotatably movable relative thereto, said guide member having an integral boss adapted to slip fit within the aperture of the other of the walls of the housing member;

an actuator member carried by the handle member for vertical movement relative to the handle member and having associated means connecting with the door latch to unlatch the door latch upon axial movement of the actuator member;

cam means acting between the handle member and the actuator member to effect axial relative movement therebetween in response to rotary movement of the handle;

spring means acting to urge the handle member and the guide member axially apart so that the respective bosses thereof are retained in engagement of the coaxially aligned apertures of the housing upper and lower walls to thereby journal the handle member on the housing for rotary movement;

and means acting between the actuator member and the housing member and adapted to prevent the actuator member from rotating whereby rotary movement of the handle member acts through the cam means to effect axial movement of the actuator member and unlatching of the door latch.

3. The door handle of claim 2 further characterized by the spring means having ends seated respectively upon the actuator member and the guide member so that the spring acts to maintain the cam means in engagement as well as urge the housing member and the actuator member apart so that the respective bosses thereof are retained in engagement of the coaxially aligned apertures of the housing upper and lower walls to thereby journal the handle member on the housing for rotary movement.

4. The door handle of claim 2 further characterized by the housing member, the actuator member and the guide member each being a molded plastic circular cylindrical member concentrically mounted in slip fitting relationship with respect to one another.

5. The door handle of claim 2 further characterized by the housing member having a vertical extending slot therein and the actuator member having an actuator arm projecting therefrom and extending through the housing slot to prevent the actuator member from rotating whereby rotary movement of the handle member acts through the cam means to effect axial movement of the actuator member and unlatching of the door latch.

6. A vehicle door handle for mounting on a vehicle door and actuating a door latch comprising:

a housing member adapted for mounting on the vehicle door;

a handle member rotatably mounted on the housing member and being a circular cylindrical member having a central bore;

a circular cylindrical actuator member mounted within the bore of the handle member for axial movement relative to the handle member and having associated means connecting with the door latch to unlatch the door latch upon axial movement of the actuator member relative to the housing member;

and cam means acting between the handle member and the actuator member to effect axial relative movement of the actuator member in response to rotary movement of the handle member, thereby unlatching the door latch.

7. The door handle of claim 6 further characterized by the housing member being mounted within an aperture of the vehicle door and constructed of molded plastic and having an integrally molded escutcheon thereon to overlie the aperture in the door.

* * * * *